US007562545B2

(12) United States Patent
Lai et al.

(10) Patent No.: US 7,562,545 B2
(45) Date of Patent: Jul. 21, 2009

(54) PADLOCK WITH FULLY INTEGRATED DUAL LOCKING SYSTEMS

(75) Inventors: Eric Lai, Tai Po (HK); Karl Lai, Tai Po (HK)

(73) Assignee: The Sun Lock Company, Ltd., Hong Kong (HK)

( * ) Notice: Subject to any disclaimer, the term of this patent is extended or adjusted under 35 U.S.C. 154(b) by 283 days.

(21) Appl. No.: 11/399,139

(22) Filed: Apr. 6, 2006

(65) Prior Publication Data

US 2006/0243005 A1 Nov. 2, 2006

Related U.S. Application Data

(60) Provisional application No. 60/676,561, filed on Apr. 29, 2005.

(51) Int. Cl.
*E05B 37/02* (2006.01)

(52) U.S. Cl. ..... 70/21; 70/25; 70/38 B; 70/38 C; 70/284; 70/285

(58) Field of Classification Search ..... 70/21, 70/25, 26, 30, 49, 38 A, 38 B, 38 C, 284, 70/285, DIG. 63, DIG. 71
See application file for complete search history.

(56) References Cited

U.S. PATENT DOCUMENTS

| | | | | | |
|---|---|---|---|---|---|
| 972,171 | A * | 10/1910 | Dupont | 70/21 |
| 1,755,521 | A * | 4/1930 | Smith | 70/21 |
| 2,001,262 | A * | 5/1935 | North | 70/21 |
| 2,090,631 | A * | 8/1937 | Junkunc | 70/285 |
| 2,133,528 | A * | 10/1938 | Bell | 70/25 |
| 2,163,852 | A * | 6/1939 | Pond | 70/21 |
| 2,931,204 | A * | 4/1960 | Check | 70/21 |
| 3,009,345 | A * | 11/1961 | Check | 70/21 |
| 4,055,972 | A * | 11/1977 | Calegan | 70/21 |
| 6,708,534 | B1 * | 3/2004 | Ruan | 70/38 A |
| 6,792,778 | B1 * | 9/2004 | Chen | 70/21 |
| 6,843,080 | B1 * | 1/2005 | Yu | 70/21 |
| 2006/0179899 | A1 * | 8/2006 | Yu | 70/21 |

* cited by examiner

*Primary Examiner*—Lloyd A Gall
(74) *Attorney, Agent, or Firm*—Melvin I. Stoltz

(57) ABSTRACT

By providing two separate and independent locking systems formed in a single padlock, with both locking systems independently enabling a single shackle latching member to be controllably activated for allowing the single shackle to be released and/or lockingly engaged, an effective, easily produced, multi-purpose padlock is achieved. In the preferred embodiment, a single housing and shackle assembly are employed and constructed for enabling the shackle to be released from locked engagement with the shackle latching member by using either a rotatable dial combination construction or a key activating tumbler construction. In this way, a dual locking and releasing padlock is achieved which virtually eliminates the difficulties typically encountered with known, prior art lock configurations.

11 Claims, 9 Drawing Sheets

PADLOCK WITH FULLY INTEGRATED DUAL LOCKING SYSTEMS

RELATED APPLICATIONS

This application is related to U.S. Provisional Patent Application Ser. No. 60/676,561, filed Apr. 29, 2005 entitled PADLOCK WITH FULLY INTEGRATED DUAL LOCKING SYSTEMS.

TECHNICAL FIELD

This invention related to padlocks and lock systems and, more particularly, to padlocks constructed to provide two separate an independent modes by which the padlock can closed.

BACKGROUND ART

Numerous padlock constructions have been developed and are widely employed by individuals to prevent unauthorized persons from gaining access to any particular item or area which has been closed and locked. Although many locks are constructed to be opened by a key, numerous combination lock constructions have been developed which are opened by knowledge of a particular combination.

One particular type of combination lock that has become very popular due to its ease and convenience of use is a combination lock which employs a plurality of rotatable independent dials, each of which forms one of the indicia, usually numerals or letters, which comprise the combination for releasing the lock. Typically, the combination lock has one mode or position in which the user is able to set or reset the desired combination sequence. Although locks of this general nature have been available for several decades, these prior art combination lock constructions suffer from common deficiencies which have not been successfully overcome.

Although many manufacturers have attempted to solve the problems associated with rotatable dial or combination locks, one principal difficulty and drawback these prior art constructions have been unable to overcome is a construction which assures the user that a preset combination will not be accidentally or inadvertently altered or changed, without the user's knowledge. In such instances when the known combination is unknowingly changed or altered without the user's knowledge, the entire combination lock is incapable of future use, since the user is typically unable to release the shackle from locked engagement with the housing.

In addition, although key operated locks do not suffer from the difficulty of having the combination changed or altered without the user's knowledge, users are frequently incapable of using key operated locks, due to the key being lost or misplaced. As a result, prior art key operated locks are also frequently discarded due to the user's inability to find a particular key for operating the lock.

Another common problem which has consistently plagued prior art constructions is the cost of construction for producing and assembling prior art padlocks, whether the padlock is key operated or combination operated. In order to attain a padlock which provides all of the features desired by consumers, prior art constructions typically incorporate numerous small components, each of which require expensive assembly procedures to produce the final product. As a result, these prior art lock constructions are expensive to produce, thereby reducing the ability of these locks to reach a broad base of consumers.

Another problem commonly found with prior art padlocks is the inability of these prior art constructions to prevent contaminants from reaching the rotatable, internal component of the lock, thereby causing damage to these components or interfering with the ease of operating the lock by an individual who either knows the actual combination or has the activating key. Although numerous attempts have been made to reduce the adverse effects caused by contaminants reaching these components, such attempts have been incapable of completely eliminating this problem.

A final, still further difficulty, which has recently arisen and affects both combination locks and key operated locks, is a requirement that all secured locks must be broken by Customs officers, and/or inspection or security personnel in order to gain access to luggage which is deemed suspicious. Under new security regulations being implemented, all luggage must be scanned or inspected to prevent the transportation of potentially dangerous items or products which are deemed to be undesirable. In those instances when luggage is scanned and further visual inspection is required, the inspectors have the authority to open the luggage for visual inspection, including physically breaking any lock which may be on the luggage.

Consequently, with these new regulations presently implemented, all prior art lock systems which are incapable of being opened by inspectors and/or security personnel are subject to be physically broken, in order to gain access to any luggage which needs to be visually inspected. As a result, consumers will now be faced with the possibility that any lock system employed to protect the contents of a suitcase can be physically removed by security personnel, leaving the luggage completely unprotected during the remainder of the trip.

Therefore, it is a principal object of the present invention to provide a padlock construction which incorporates two separate and independent locking zones constructed for securely locking virtually all typical products by employing a single locking member.

Another object of the present invention is to provide a padlock construction having the characteristic features described above which employs a single latching member which is controlled by either locking zone.

Another object of the present invention is to provide a padlock construction having the characteristic features described above which virtually eliminates the ability of unauthorized persons from gaining access to the lock by attempting to pick the lock using known techniques.

Another object of the present invention is to provide a padlock construction having the characteristic features described above wherein one locking zone is key controlled and the second locking zone is combination controlled.

Another object of the present invention is to provide a padlock construction having the characteristic features described above which employs a minimum of components and is quickly and easily assembled, thereby providing a lock capable of being constructed at a competitive price.

Another object of the present invention is to provide a padlock construction having the characteristic features described above which effectively seals the rotating components from external contamination and effectively prevents any external contaminants from reaching the rotating components thereof.

Other and more specific objects will in part be obvious and will in part appear hereinafter.

SUMMARY OF THE INVENTION

By employing the present invention, all of the difficulties and drawbacks of the prior art constructions are virtually eliminated and an effective, easily produced, padlock is achieved which incorporates two separate and independent locking systems formed in a single padlock, with both locking systems independently enabling the single shackle to be released and/or lockingly engaged. In this way, by using the key activating feature, a user is assured of the ability to release the shackle from locked engagement whenever the combination is forgotten, altered or changed without the user's knowledge. Similarly, whenever the key is lost or misplaced, the user is still able to release the shackle from locked engagement with the housing by employing the known combination.

In accordance with the present invention, a single housing and shackle assembly are employed and constructed for enabling the shackle to be released from locked engagement with the housing using either a rotatable dial combination construction or a key activating tumbler construction. In this way, a dual locking and releasing padlock is achieved which virtually eliminates the difficulties typically encountered with known, prior art lock configurations.

In each of the alternate preferred embodiments of the present invention, the shackle cooperatively associated with the housing comprises either a generally U-shape or a J-shape. In addition, in the preferred construction of these alternate embodiments, one leg portion of the shackle is cooperatively associated with the housing for both axial or longitudinal movement relative to the housing, while also being arcuately pivotable or rotational relative to the housing about the central axis of the leg portion.

The second leg portion of the shackle is constructed for cooperative association with a shackle locking and releasing member which controls the movement of the shackle relative to the housing. Furthermore, as fully detailed below, the locking/releasing member is also cooperatively associated with two separate and independent locking systems formed in the padlock for enabling either locking system to independently control the release of the shackle relative to the housing, whenever desired.

By employing any of the alternate embodiments of the present invention, the release of the shackle from locked engagement with the housing causes one leg of the shackle to move axially relative to the housing, while simultaneously releasing the second leg of the shackle from engagement in the housing in order to disengage the second leg from locked engagement with the housing. This disengagement and release of the shackle is achieved by either the proper positioning of rotatable, combination defining dials or by employing a key to activate the rotatable tumbler/chamber locking assembly of the housing. By employing either of the two alternate locking systems incorporated into the housing of the present invention, the desired release of the shackle from the housing is attained.

By employing the dual locking system of the present invention, all of the difficulties and drawbacks found in prior art constructions are overcome. In the present invention, the user is capable of employing either of two separate and independent shackle controlling locking systems for releasing the shackle from locked engagement with the housing whenever release is desired. As a result, if the control system for one of the locking modes is not available, the second mode can be employed for completely operating the padlock in the desired manner.

In addition, by employing the dual locking constructions of the present invention, all of the difficulties and drawbacks which travelers face under newly enacted regulations are completely overcome. As detailed above, recently enacted regulations empower Customs officers, and/or inspection and security personnel to physically break any secured lock on a suitcase in order to gain access to a suitcase which is a believed to contain suspicious material. However, by employing the present invention, the possibility of having one's lock completely broken by Customs or security personnel is totally prevented.

By employing the dual locking mode padlocks of the present invention, which comprises a combination controlled section and key controlled section, a Master Key is created which is able to open the key controlled section of all dual mode padlocks. As a result, in the event that a Customs officer or security personnel require a particular piece of luggage to be opened for further visual inspection, the Customs officer or security personnel are able to open the dual locking mode padlocks by employing the Master Key, which is provided to all such individuals. In this way, physically breaking a lock is totally eliminated and, once visual inspection has been completed, the dual locking mode padlocks would be replaced on the luggage and locked in position, in order to assure that the contents remains secure throughout the remainder of the trip.

Furthermore, the padlocks of the present invention are constructed with the interior chambers virtually sealed from the ambient surroundings, thereby preventing unwanted contamination from entering the interior of the padlock and the rotating component thereof. In this way, prior art degradation and interference of the lock operation by contamination is virtually eliminated.

In addition, in accordance with the present invention, a minimum number of components are employed in combination with the housing and the movable shackle, in order to provide the desired unique, dual mode padlock constructions of the present invention. In addition to the shackle and housing, only the plurality of rotating dials, plurality of tumblers sleeves, key operated tumblers and rotatable chamber are required to provide the dual mode padlock constructions of this invention.

In addition to the features detailed above, the present invention achieves a dual mode padlock using a minimum number of independent components, each of which is capable of being quickly assembled into the final product. As a result, a construction is attained which is capable of being manufactured at a competitive price, while providing a high quality, highly effective dual mode padlock which virtually eliminates any degradation due to exposure to environmental contamination.

The invention accordingly comprises an article of manufacture possessing the features, properties, and the relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which.

DETAILED DISCLOSURE

Figure 2:
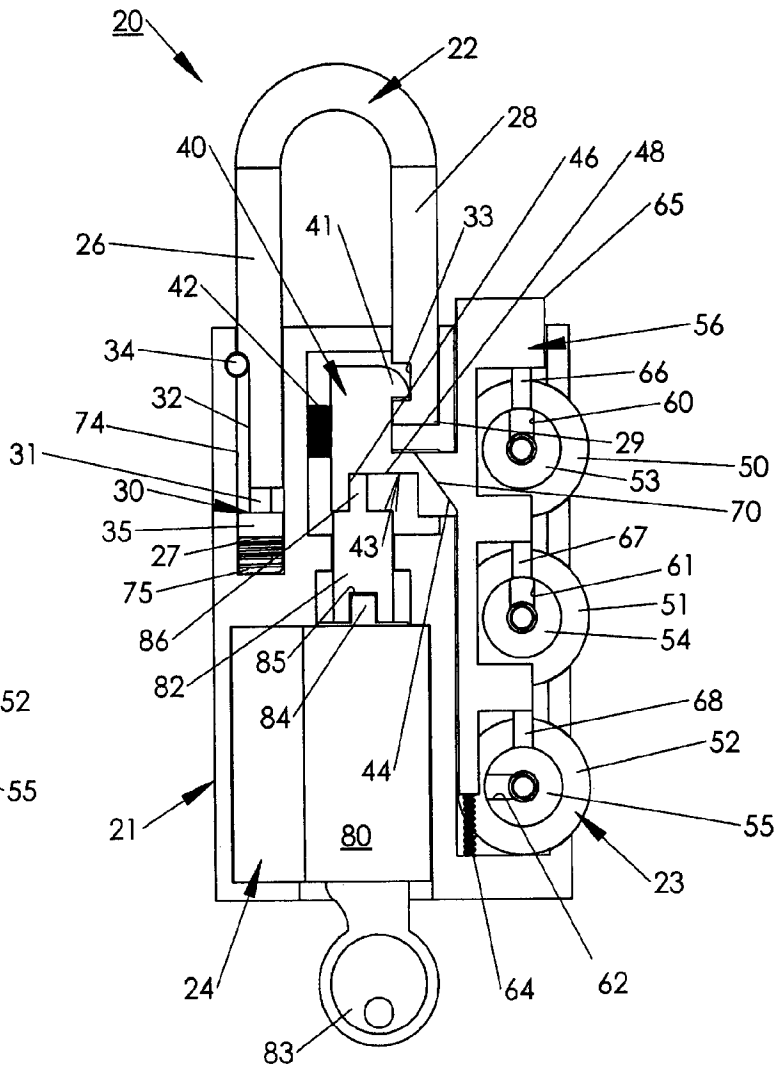
FIG. 2 is a side elevation view of the padlock of FIG. 1.

By referring to FIGS. 1-23, along with the following detailed discussion, the construction and operation of four alternate embodiments of dual locking mode padlock 20 of the present invention can best be understood. Although four, alternate embodiments of the present invention are fully detailed below and completely depicted in FIGS. 1-23, further alternate embodiments of the present invention can be implemented without departing from the scope of the present invention. Consequently, it is to be understood that the following detailed disclosure, as well as the associated drawings, are provided for exemplary purposes only and are not intended as a limitation of the present invention.

In FIGS. 1-4, a first preferred embodiment of dual locking mode padlock 20 of the present invention is depicted. In this embodiment, padlock 20 incorporates two principal components, housing 21 and shackle 22. In addition, as depicted, housing 21 incorporates combination controlled locking section 23 formed on one side thereof and key control locking section 24 formed on the opposed side thereof. The components required for forming and operating combination controlled locking section 23, as well as the components required for forming and operating key controlled locking section 24, are all detailed below. However, regardless of the section used by an individual to lock and/or unlock padlock 20 of the present invention, the cooperative engagement of shackle 22 with housing 21 is employed.

In the preferred construction of this embodiment of the present invention, shackle 22 comprises a generally J-shape or a U-shape, incorporating first leg 26 which comprises terminating end 27 and a second leg 28 which comprises terminating end 29. In addition, leg 26 incorporates cut out zone 30 formed therein inwardly of terminating end 27, effectively creating post 31 and cylindrical portion 35 which is formed between one end of post 31 and terminating end 27. In addition, a portion of the outer surface of leg 26 is cut away above the opposed end of post 31, establishing substantially flat surface 32. As clearly depicted in FIGS. 1-4, and further discussed below, these components of leg 26 cooperate with pin 34 of housing 21 to enable shackle 22 to move between its closed position and its open position, as well as enabling shackle 22 to arcuately rotate about the central axis of leg 26 when shackle 22 is in its open position, while being retained in housing 21.

In completing the construction of shackle 22, leg 28 incorporates notch 33 formed therein directly adjacent terminating end 29. As is more fully detailed below, notch 33 of shackle 22 is constructed for cooperating with a locking finger to control the locked engagement of shackle 22 in housing 21, as well is the release thereof.

In order to provide the desired controlled release of shackle 22 from housing 21, whenever dual locking mode padlock 20 has been moved into the open position by the operation of either combination controlled locking section 23 or key controlled locking section 24, dual locking mode padlock 20 incorporates latch plate 40 movably mounted in housing 21 in cooperating relationship with movement controlling spring 42. As depicted, latch plate 40 incorporates locking finger 41 and cut out zone 43 formed in the lower end of latch plate 40. Preferably, cut-out zone 43 incorporates side surfaces 46 and 47 and interconnection surface 48. In addition, directly adjacent cut out zone 43, latch plate 40 also incorporates slanted or sloping edge or surface 44.

In this embodiment of the present invention, locking finger 41 of latch plate 40 engages notch 33 of leg 28 of shackle 22 whenever padlock 20 is in the locked position. In order to normally maintain padlock 20 in the locked position, movement control spring 42 is mounted in biasing engagement with latch plate 40, continuously urging and maintaining latch plate 40 and locking finger 41 engaged with notch 33 of shackle 22. As a result, as is more fully detailed below, whenever shackle 22 is to be released from locked engagement in housing 21 of padlock 20, latch plate 40 must be moved against the biasing forces of spring 42, compressing spring 42 and causing locking finger 41 to disengage from notch 33 of shackle 22.

In order to disengage or release shackle 22 from locked engagement with housing 21 of padlock 20, one of the locking sections of padlock 20 must be activated. In order to enable combination controlled section 23 to be capable of releasing shackle 22 from housing 21, this embodiment of the present invention incorporates dials 50, 51, and 52 which are rotatably mounted in housing 21, cooperatively associated with tumblers 53, 54, and 55. In addition, slider 56 is also mounted in combination controlled locking section 23, for cooperating with dials 50, 51, and 52 for enabling shackle 22 to be released only when the preset combination has been properly entered on dials 50, 51, and 52.

In the preferred construction of this embodiment of the present invention, rotatable dial 50 is cooperatively associated with clutch ring 53 which incorporates a pin receiving slot 60. Similarly, rotatable dial 51 is associated with clutch ring 54, with clutch ring 54 incorporating pin receiving slot 61. Finally, rotatable dial 52 is associated with clutch ring 55, with clutch ring 55 incorporating pin receiving slot 62. Furthermore, dials 50, 51, and 52 and their associated clutch rings 53, 54, and 55 are rotationally mounted to housing 21 about separate axes, each of which are parallel to each other. As a result, dials 50, 51, and 52 are mounted to housing 21 in a side-by-side position, with each dial lying in the same plane. In addition, slider 56 is constructed to move in a generally vertical or longitudinal direction within housing 21, with slider 56 biased to be in a raised or upward position, due to the biasing forces of spring 64. Furthermore, in order to control the movement of slider 56, slider 56 incorporates a readily accessible pushbutton forming surface 65 formed at one terminating end of slider 56 and positioned for extending outwardly from housing 21, thereby enabling pushbutton forming surface 65 to be a readily accessible.

Slider 56 also incorporates pins 66, 67, and 68 independently extending therefrom and positioned for cooperating association with one of the pin receiving slots 60, 61, and 62 of clutch rings 53, 54, and 55. Furthermore, slider 56 incorporates slanted, sloping surface 70 which is positioned for sliding, contacting engagement with slanted, sloping edge/surface 44 of latch plate 40. As depicted, slanted, sloping surface 70 is angularly constructed for engaging and controlling the movement of latch plate 40 by its contact with sloping surface 44 whenever slide 56 is able to be moved downwardly.

By employing this construction, pins 66, 67, and 68 are aligned with receiving slots 60, 61, and 62 of clutch rings 53, 54, and 55, whenever rotating dials 50, 51 and 52 are placed in the desired, preset position. When this condition has been met, with all three pin receiving slots aligned with each of the pins of slider 56, slider 56 is able to move vertically downwardly, causing sloping surface 70 of slider 56 to controllably contact sloping edge/surface 44 of latch plate 40, forcing latch plate 40 to move horizontally against the forces of spring 42.

This horizontal, sliding movement causes locking finger 41 to be withdrawn from notch 33, thereby releasing shackle 22 from locked engagement in housing 21 of padlock 20. As a result, padlock 20 is unlocked, and shackle 22 is able to be withdrawn from engagement in housing 21 by axial movement of leg 28 of shackle 22 out from housing 21.

In the preferred construction, housing 21 incorporates receiving hole 74 formed therein and positioned for receiving and retaining leg 26 of shackle 22. In addition, pin 34 which is cooperatively associated with leg 26 is mounted directly adjacent the entry to receiving hole 74. In addition, spring means 75 is mounted at the base of receiving hole 74, in contact with terminating end 27 of leg 26 of shackle 22. In this way, a continuous biasing force is exerted on shackle 22, continuously urging shackle 22 to move upwardly. However, this upward movement is only attainable when locking finger 41 of latch plate 40 has been withdrawn from engagement in notch 33 of shackle 22.

Figure 3:
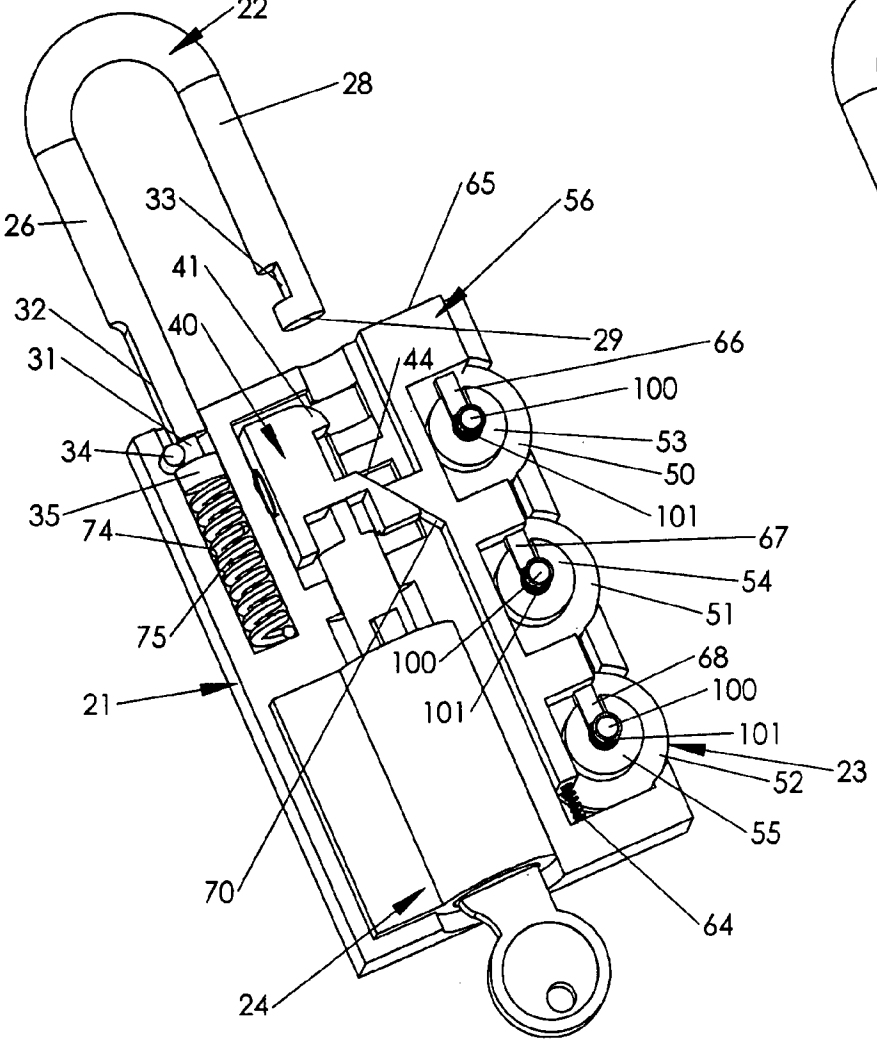
FIG. 3 is a perspective view of the padlock of FIG. 1 shown with the cover removed and with the padlock in the open position by employing the combination portion thereof.

As shown in FIG. 3, once a shackle 22 has been released from locked engagement with housing 21, spring 75 is able to force leg 26 of shackle 22 upwardly, completely removing leg 28 of shackle 22 from engagement in housing 21. In this way, terminating end 29 of leg 28 of shackle 22 is completely removed from housing 21, and is capable of being employed for engaging any desired product for being locked.

Furthermore, flat surface 32 formed in leg 26 effectively reduces the diameter of leg 26, enabling shackle 22 to move upwardly past pin 34. However, since cylindrical portion 35 comprises the full diameter of leg 26 of shackle 22, the top surface of cylindrical portion 35 abuts pin 34, preventing the complete removal of shackle 22 from housing 21. Furthermore, since post 31 is directly adjacent cylindrical portion 35 and comprises a substantially reduced diameter, shackle 22 is capable of being arcuately rotated about its central axis, enabling free end 29 of leg 28 to be inserted through any desired product to be securely locked prior to re-engaging shackle 22 in housing 21.

As is evident from the foregoing detailed discussion, combination controlled the locking section 23 is only capable of releasing shackle 22 from housing 21 when the precisely desired combination has been inputted onto dials 50, 51, and 52. In this regard, one structural feature which is important to note is the incorporation of pin receiving slots 60, 61, and 62 and clutch rings 53, 54, and 55, since each pin receiving slot 60, 61, and 62, in combination with rotatable dials 50, 51, and 52, control the locking and unlocking of the combination controlled locking section 23 of padlock 20.

As discussed above, activation or movement of slider 56 is only possible when pins 66, 67, and 68 of slider 56 are precisely aligned with slots 60, 61, and 62 of clutch rings 53, 54, and 55. However, as depicted in FIG. 2, when any one of the pin receiving slots 60, 61, and 62 of clutch rings 53, 54, and 55 is placed in an orientation other than one which is aligned with the position of pins 66, 67, and 68, movement of slider 56 is prevented. In this way, combination controlled locking section 23 is only capable of being used by individuals who know the preset combination and are capable of entering that preset combination onto rotatable dials 50, 51, and 52.

Figure 7:
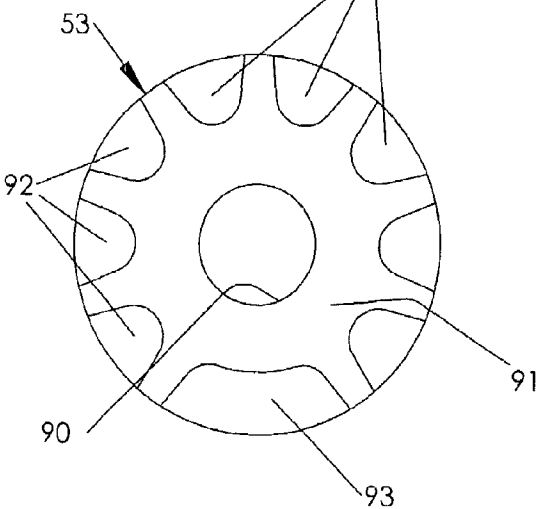
FIG. 7 is a top plan view of the clutch ring of FIG. 5.
Figure 6:
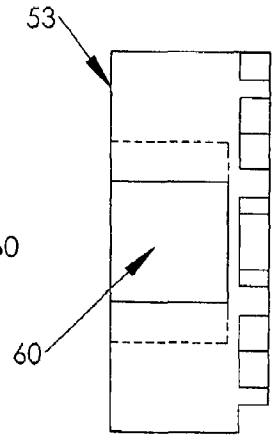
FIG. 6 is a side view of the clutch ring of FIG. 5.
Figure 5:
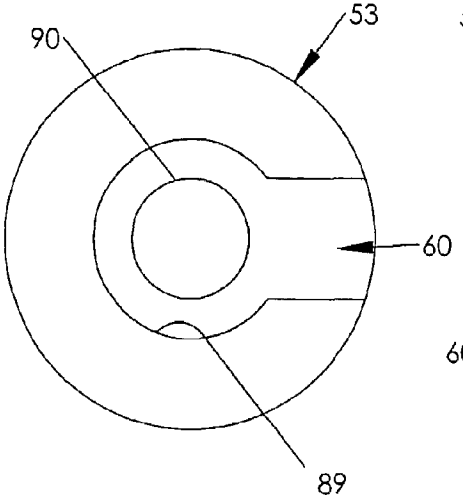
FIG. 5 is a bottom plan view of a clutch ring employed in the dual locking mode padlock of the present invention.
Figure 10:
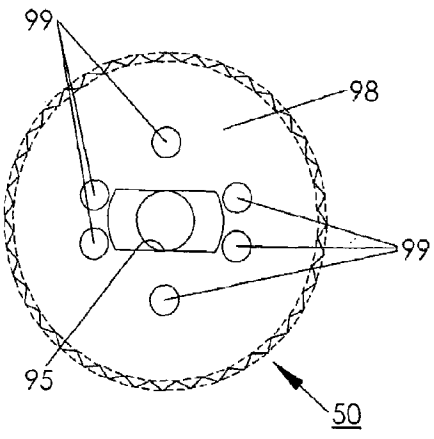
FIG. 10 is a bottom plan view of the dial of FIG. 8.
Figure 9:
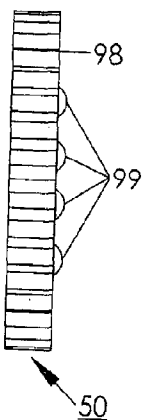
FIG. 9 is a side view of the dial of FIG. 8.
Figure 8:
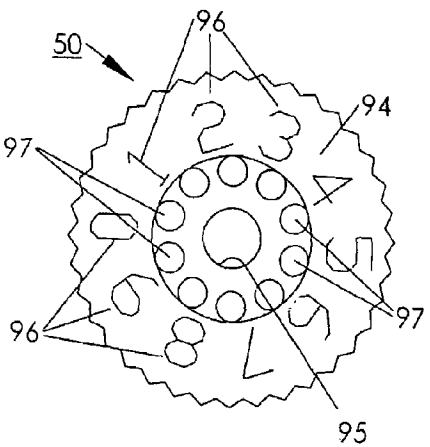
FIG. 8 is a top plan view of a dial employed in the dual locking mode padlock of the present invention.

In FIGS. 5, 6 and 7, the construction of clutch ring 53 is fully shown, while FIGS. 8, 9 and 10 fully depict the construction of dial 50. By referring to these figures, along with the following detailed discussion, the construction and operation of clutch rings 53, 54, and 55 and dials 50, 51 and 52 can best be understood, since each clutch ring and each dial are identical in construction in use.

In this preferred construction, clutch ring 53 comprises a generally circular shape having a diameter which is less than the diameter of dial 50. In addition, a first, centrally disposed, circular hole 90 is formed in clutch ring 53 along with a second centrally disposed circular hole 89 having a diameter greater than hole 90. Both holes 89 and 90 are aligned with the central axis of clutch ring 53. Furthermore, as detailed above, slot 60 is formed in clutch ring 53 extending from the outer surface of clutch ring 53 to hole 89.

As shown in FIG. 7, clutch ring 53 comprises a dial contacting surface 91, with dial contacting surface 91 incorporating a plurality of notched zones 92 formed about the entire outer peripheral surface of clutch ring 53 and an enlarged notched zone 93. In the preferred embodiment, each notch zone 92 is substantially identical to each other and is formed in a generally U-shape.

As shown in FIGS. 8-10, dial 60 comprises a generally circular shape having an overall diameter greater than the diameter of clutch ring 53 and incorporating a centrally disposed circular hole 95, coaxially aligned with the center of dial 50. In addition, dial 50 incorporates a top surface 94 on which a plurality of indicia 96 are formed for ease of visibility. In the preferred embodiment, indicia 96 comprises numerals ranging from 0 through 9, with each numeral being placed adjacent each other in substantially equal spaced intervals. Finally, top surface 94 comprises a plurality of substantially circular shape recess zones 97 formed about hole 95 in a generally circular configuration.

As shown in FIG. 10, dial 60 comprises a bottom surface 98 on which a plurality of raised bumps or bosses 99 are formed in spaced relationship with hole 95. Although the construction, position, and configuration of raised bumps 99 can be varied or altered depending upon particular goals and objectives being sought, the general configuration of raised bumps 99 are designed for cooperative engagement with notched zones 92 and 93 of clutch ring 70.

By properly constructing raised bumps 99 and notched zones 92 and 93, locked interengagement of clutch ring 53 with a dial 50 is attained, as well as independent rotational movement of each component relative to the other. In this way, as is more fully detailed below, any desired combination can be preset for opening padlock 20 using a construction which is reasonably inexpensive to produce, while providing highly reliable results.

By referring to FIG. 3, along with the following detailed discussion, the cooperative engagement and operation of dials 50, 51 and 52 along with clutch ring 53, 54, and 55 can best be understood.

Figure 1:
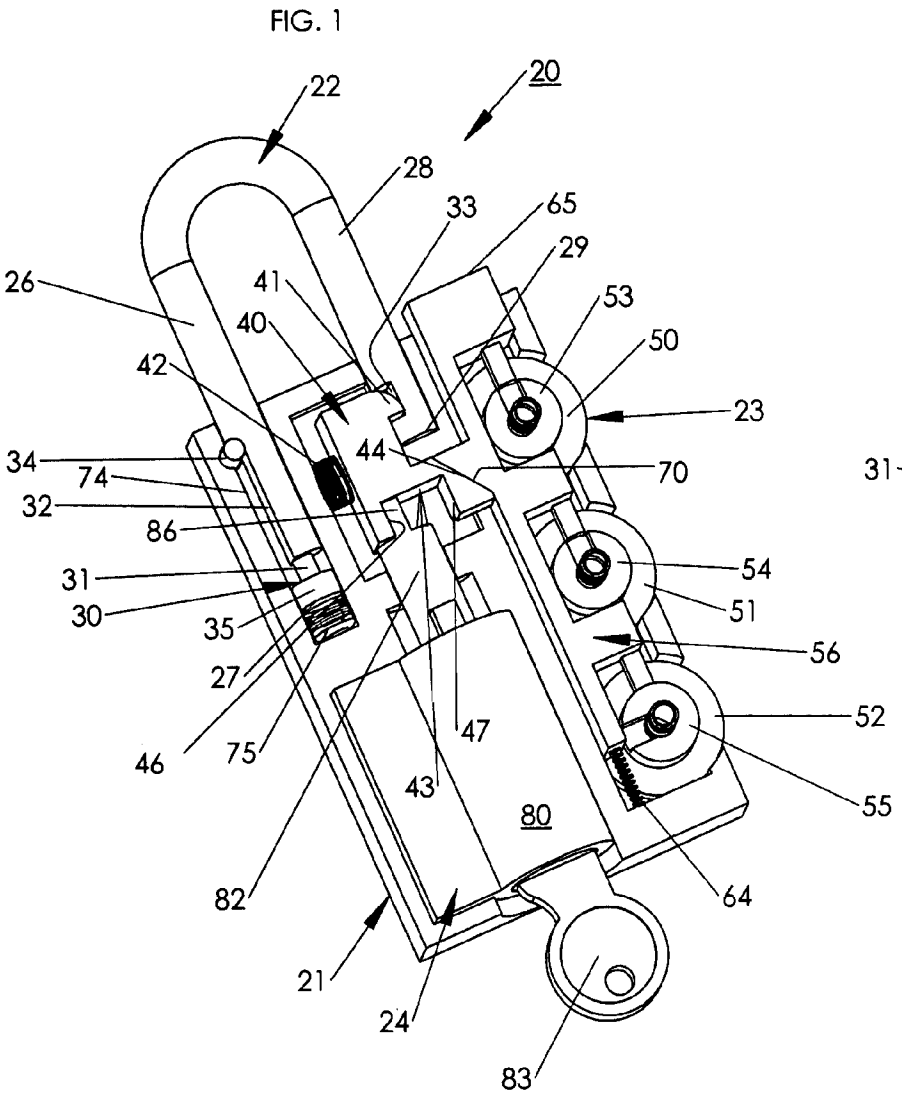
FIG. 1 is a perspective view of one embodiment of the padlock of the present invention with the fully integrated dual locking system shown in the locked position with the cover removed up.
Figure 4:
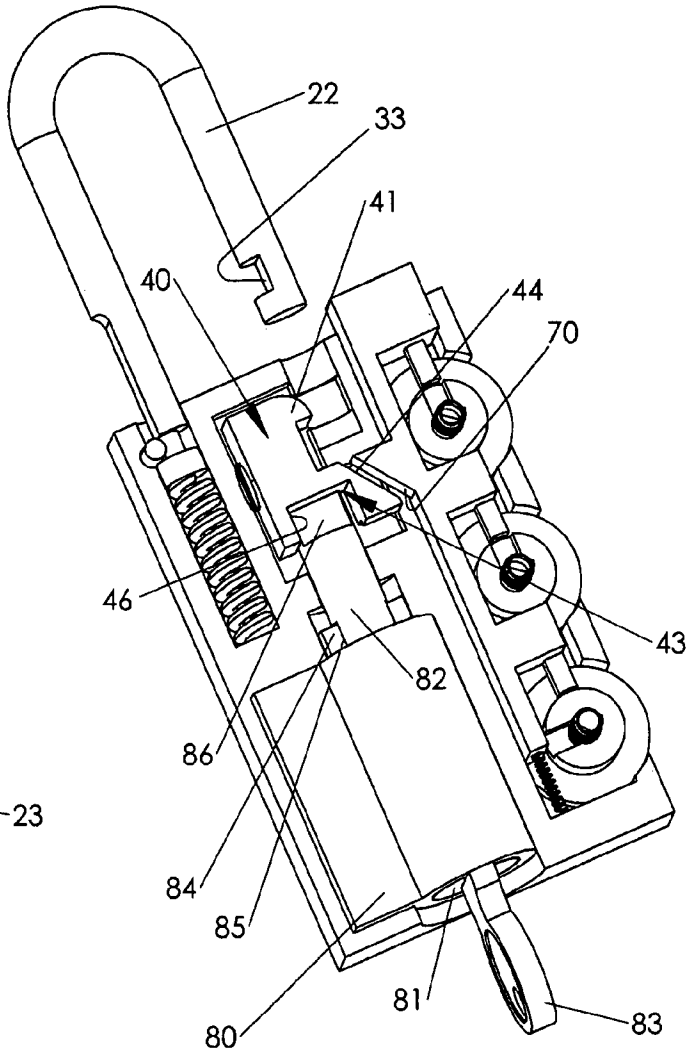
FIG. 4 is a perspective view of the padlock of FIG. 1 shown with the cover removed and with the padlock in the open position by employing the key operated portion thereof.

As best seen in FIGS. 1 and 3, dial 50 is mounted on post 100 which is formed as part of housing 21. The diameter of post 100 is constructed for cooperating with hole 95 of dial 50 and hole 90 of clutch ring 53. By employing complementary diameters for each of these components, dial 50 and clutch ring 53 are easily mounted about post 100 and freely rotatable about post 100. In addition, dial 50 is mounted on post 100, with surface 91 of clutch ring 53 mounted in contacting engagement with surface 98 of dial 50. The assembly of these components is completed by mounting spring member 101 on post 100 in hole 89 in biasing, contacting engagement with clutch ring 53.

As stated above, hole 89 of clutch ring 53 comprises a diameter larger than hole 90 to enable spring member 101 to be placed in hole 89, freely surrounding post 100 and extending therefrom. Once housing 21 is closed and sealed, spring member 101 is maintained under compression, exerting a biasing force against clutch ring 53, assuring that clutch ring 53 is continuously urged into frictional engagement with dial 50. By employing this construction, the rotational movement of dial 50 by the user causes clutch ring 53 to rotate simultaneously therewith.

By employing the construction detailed above, the user is able to quickly and easily unlock and lock shackle 22. In order to place padlock system 20 in the unlocked or open position, dials 50, 51, and 52 are rotated about the axis defined by post 100 of housing 21 until the pre-selected, combination-defining indicia 96 formed on dials 50, 51, and 52 are placed in the desired position.

As detailed above, since clutch rings 53, 54, and 55 are biased into frictional engagement with dials 50, 51, and 52, the rotation of dials 50, 51, and 52 causes clutch rings 53, 54, and 55 to rotate therewith. Consequently, the position of slots 60, 61, and 62 in clutch rings 53, 54, and 55 are placed in the desired aligned position with fingers 66, 67, and 68 of slider 56 whenever the preset combination indicia of dials 50, 51, and 52 are placed in the proper orientation. Once the indicia representing the preset combination are properly positioned, the movement of slider 56 is enabled and shackle 22 can be freely removed from locked engagement with housing 21.

In addition, the construction detailed allows the user to individually select any desired combination for padlock 20 and input the desired combination to system 20 prior to use. In order to attain this result, the user places indicia 96 on dials 50, 51, and 52 in the existing combination and then locks clutch rings 53, 54, and 55 by advancing slider 56 downwardly. As detailed above, the movement of slider 56 causes pins 66, 67 and 68 of slider 56 to engage slots 60, 61 and 62 of clutch rings 53, 54, and 55, thereby preventing clutch rings 53, 54, and 55 from rotating.

By maintaining clutch rings 53, 54, and 55 in this locked position, the user rotates dials 50, 51, and 52 until any desired indicia 96 are selected. Once the indicia representing a new combination are displayed, the user releases slider 56, thereby disengaging clutch rings 53, 54, and 55 from their locked position.

Although clutch rings 53, 54, and 55 are biased into frictional engagement with dials 60, 61, and 62 by spring members 100, clutch rings 53, 54, and 55 are incapable of being rotated by dials 50, 51 and 52 when the clutch rings are held in position by slider 56. As a result, the user is able to overcome the frictional engagement between clutch rings 53, 54, and 55 and dials 50, 51 and 52, enabling dials 50, 51, and 52 to be rotated relative to clutch rings 53, 54, and 55 for altering indicia 96 of the preset combination. In this way, any desired combination can be inputted into padlock 20 of the present invention.

In addition to enabling padlock 20 to be opened by employing combination controlled locking section 23 of housing 21, the dual mode padlock 20 of the present invention also incorporates key controlled locking section 24 formed as an integral part of housing 21 for enabling padlock 20 to be unlocked in a separate and independent alternate manner. By referring to FIGS. 1, 2 and 4, along with the following detailed discussion, the construction and operation of this key controlled locking and unlocking mode of padlock 20 can best be understood.

In this preferred construction of the present invention, key controlled locking section 24 of housing 21 incorporates lock bearing housing 80, within which cylinder 81 is rotationally journalled. In the preferred embodiment, cylinder 81 incorporates a key receiving slot formed in the base thereof, which is constructed for cooperating controlled relationship with key 83. Furthermore, using a generally conventional construction, cylinder 81 incorporates a plurality of spring biased tumblers mounted therein which are constructed for cooperating with cut out zones formed on key 83.

In addition, key controlled locking section 24 also incorporates rotatable cylinder 82 which is mounted in housing 21 in rotationally controlled engagement with cylinder 81. In order to assure that cylinders 81 and 82 are arcuately pivoted simultaneously, effectively functioning as a single elongated cylinder, cylinder 81 incorporates an upstanding flange or ridge 84 formed in its top section, while cylinder 82 incorporates channel 85 formed in the bottom surface thereof. By lockingly engaging flange/ridge 84 in channel 85, cylinders 81 and 82 are arcuately pivoted simultaneously. In completing the construction of key control locking section 24, cylinder 82 also incorporates an upstanding flange 86 formed at the top end thereof, with flange 86 positioned in cut out zone 43 of latch plate 40. As detailed below, the rotational movement of flange 86 causes the sliding the movement of latch plate 40.

The tumblers mounted in cylinder 81 prevent the arcuate or rotational movement of cylinder 81 relative to housing 80, unless all tumblers are positioned in a precise, predetermined alignment arrangement. When in the desired aligned position, cylinder 81 is capable of being arcuately rotated.

In order to achieve the precisely desired aligned position for enabling cylinder 81 to be arcuately rotated, key 83 is employed for placing each tumbler in the precisely desired predetermined position. In addition, key 83 provides the necessary leverage for enabling cylinder 81 to be arcuately pivoted within housing 80.

Once key 83 is inserted into the key receiving slot formed in cylinder 81, the tumblers are aligned in the precisely desired predetermined position, enabling cylinder 81 to be arcuately rotated. In addition, since flange 84 of cylinder 81 is engaged within channel 85 of cylinder 82, the arcuate pivoting movement of cylinder 81 simultaneously cause the cylinder 82 to arcuately pivot therewith. Furthermore, since flange 86 of cylinder 82 is positioned in cut out zone 43 of latch plate 40, in direct contact with side surface 46 thereof, the arcuate pivoting movement of flange 86 forces latch plate 40 to move against the biasing force of spring of 42, simultaneously causing locking finger 41 to be disengaged from notch 33 of shackle 22.

As result, once cylinder 81 has been rotated into its open position, locking finger 41 is fully disengaged from notch 33, causing shackle 22 to be removed from housing 21 and resulting in padlock 20 being moved into its open or unlocked position. In this way, the second, separate and independent locking mode for padlock 20 is easily activated, in complete control by the user or by any other authorized individual having an authorized key 83.

In FIGS. 11-14, a second preferred embodiment of dual locking mode padlock 20 of the present invention is depicted. In this embodiment, a minimum number of principal components is also employed, similar to the embodiment detailed above, thereby achieving a dual locking mode padlock, while also substantially reducing the complexity found in most prior art padlocks. In this way, the present invention provides a highly effective, commercially desirable construction, which is capable of being produced at competitive costs, while also providing the unique attributes of the present invention and all of the locking and theft deterrent features typically incorporated in prior art padlocks.

In the drawings for this embodiment of the present invention, padlock 20 is depicted with the housing completely removed, thereby enabling all of the internal components to be viewed more easily and better understood. Furthermore, the components depicted in FIGS. 11-14 which are identical in construction and operation to the components incorporated into the embodiment of the present invention depicted in FIGS. 1-10, are shown with the same reference numerals being employed for identifying these components. As a result, the foregoing detailed discussion regarding these components is incorporated herein by reference, with any detailed discussion or explanation regarding the construction and operation of these components being eliminated in order to avoid repetition. However, any question regarding the construction and/or operation of these components can be fully understood by reference to the foregoing detailed descriptions.

In addition, any variations in construction as well as new components which are incorporated into this embodiment are fully detailed herein and clearly depicted in FIGS. 11-14. Consequently, by referring to these figures, along with the following detailed discussion, the construction and operation of this second embodiment can best be understood, as well as the detailed variations between this embodiment and the previous embodiment.

In this embodiment of the present invention, padlock 20 incorporates combination controlled locking section 23 and key controlled locking section 24. In addition, padlock 20 incorporates shackle 22 which is employed for locking and unlocking padlock 20 in response to the operation of combination controlled locking section 23 and/or key control locking section 24. In this regard, shackle 22 of this embodiment operates in a substantially identical manner to the shackle detailed above, except for the incorporation of notch 110 in leg 26 of shackle 22. As is fully detailed below, notch 110 cooperates with locking means for controlling the movement of shackle 22 between its locked position and its unlocked position.

Combination controlled locking section 23 incorporates rotatable dials 50, 51, and 52 along with clutch rings 53, 54, and 55. In addition, clutch rings 53, 54, and 55 respectively incorporate pin receiving slots 60, 61, and 62. All of these elements operate in a substantially identical manner as has been fully detailed above.

In this embodiment, sliding plate 111 is employed for cooperating with rotatable dials 50, 51, and 52 as well as clutch rings 53, 54, and 55 for moving between the locked and unlocked positions. In this regard, sliding plate 111 incorporates pins 117, 118, and 119 which extend outwardly from plate 111 and are positioned for cooperative, aligned engagement in pin receiving slots 60, 61, and 62 of clutch rings 53, 54, and 55.

Whenever dials 50, 51, and 52 are positioned to display the preset combination, clutch rings 53, 54, and 55 are positioned with pin receiving slots 60, 61, and 62 in juxtaposed, aligned relationship with pins 117, 118, and 119 of sliding plate 111. Once this position is attained, sliding plate 111 is capable of being moved in a sideways direction, causing pins 117, 118, and 119 to enter pin receiving slots 60, 61, and 62, as a depicted in FIG. 13, placing padlock 20 in its unlocked position.

In order to enable the user to control the movement of sliding plate 111 and physically move plate 111 from the locked position into the unlocked position, this embodiment of padlock 20 incorporates elongated push rod 112 and latch plate 113. In the preferred construction of this embodiment of the present invention, elongated push rod 112 and latch plate 113 are both constructed for controlled sideways movement in the housing of padlock 20. In order to control the movement and positioning of these components, padlock 20 incorporates biasing spring 114 which is constructed and positioned for exerting a biasing force upon upstanding wall 120 of latch plate 113.

Furthermore, latch plate 113 incorporates locking finger 121 formed at one end thereof, positioned for engaging notch 110 of leg 26 of shackle 22. As result of this construction, latch plate 113 is continuously biased by spring 114 to cause locking finger 121 to engage notch 110 of shackle 22. In addition, when in this spring biased position, push rod 112 is also biased in this same direction, causing distal end 125 of rod 112 to be maintained in a first position, wherein end 125 extends outwardly from the housing forming padlock 20, ready for activation by the user.

In the preferred construction of this embodiment of the present invention, latch plate 113 also incorporates wall panels 126 and 127, each of which are parallel to each other and extend downwardly from latch plate 113. In addition, push rod 112 incorporates proximal end 128 and elongated slot 129 formed therein and extending between distal end 125 and proximal end 128. Furthermore, sliding plate 111 incorporates a reinforcing bar 130 formed along the upper end thereof and interconnected with sliding plate 111 in order to control the sideways movement thereof.

In the preferred assembly of these components of this embodiment of the present invention, elongated push rod 112 and latch plate 113 are mounted in cooperating association with each other, both constructed for controlled sideways movement. In addition, these components are constructed and associated with sliding plate 111 in order to control the movement of sliding plate 111 when the correct combination has been inputted on dials 50, 51, and 52.

Figure 12:
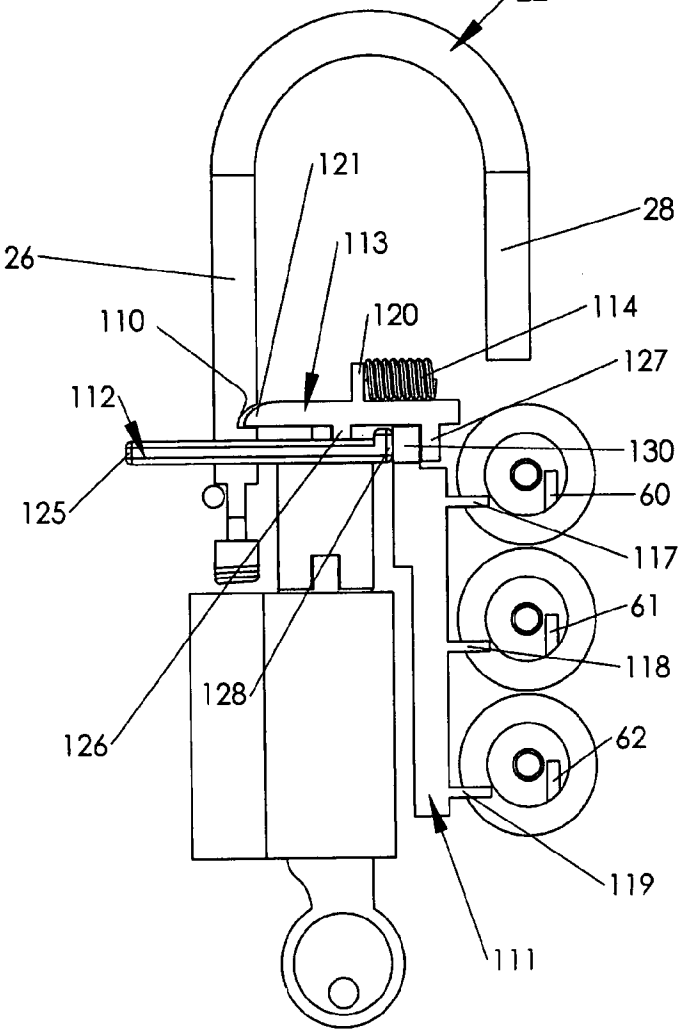
FIG. 12 is a side elevation view of the padlock of FIG. 11.
Figure 11:
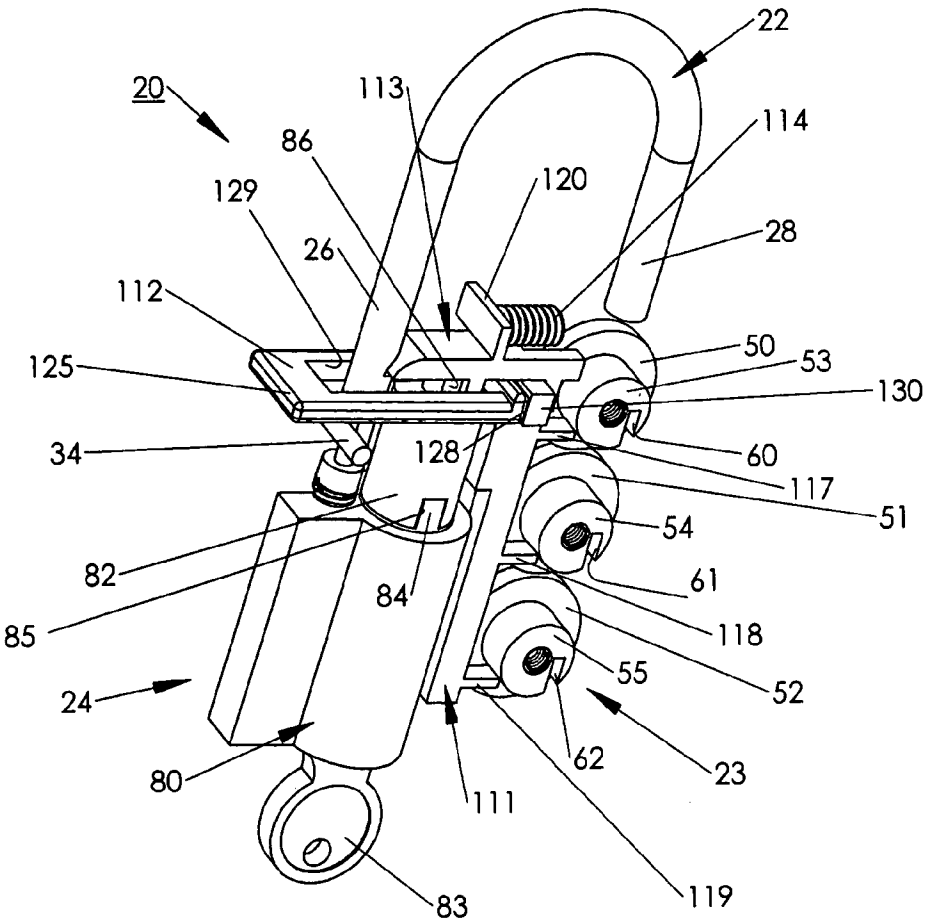
FIG. 11 is a perspective view of a second embodiment of the padlock of the present invention with the fully integrated dual locking system shown in the locked position, with both the front and rear covers removed.
Figure 14:
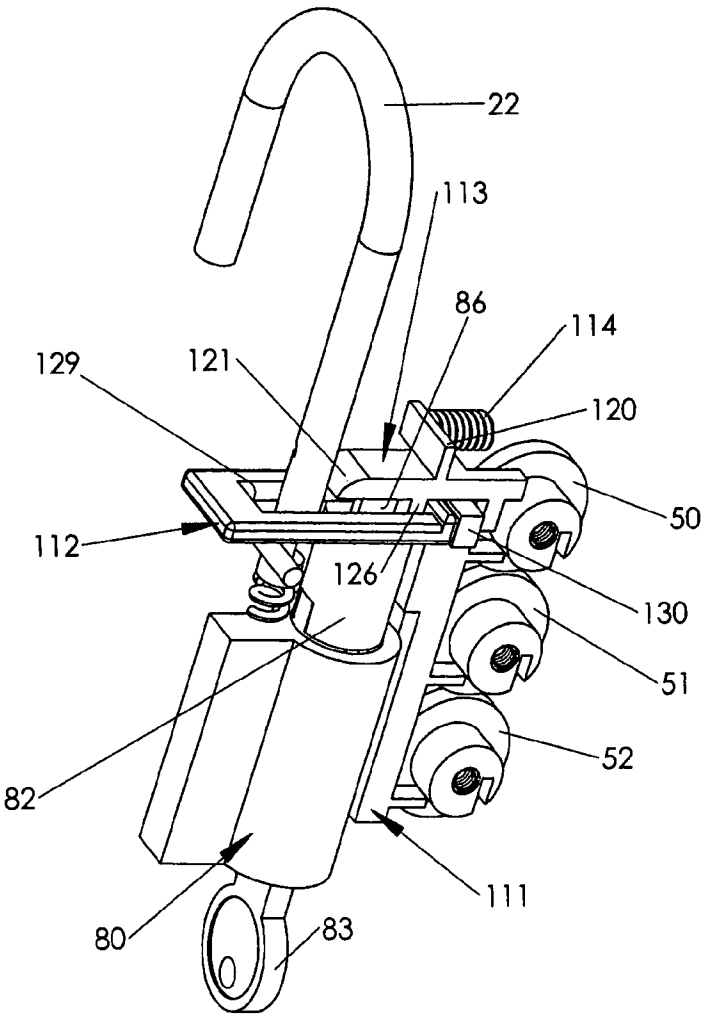
FIG. 14 is a perspective view of the padlock of FIG. 11 shown with the front and rear covers removed and with the padlock in the open position by employing the key operated portion thereof.

In this regard, proximal end 128 of push rod 112 is positioned in abutting, controlled engagement with one surface of reinforcing bar 130 of sliding plate 111. In addition, the opposed surface of reinforcing bar 130 is placed in contact with wall panel 127 of latching plate 113. Since latching plate 113 is continuously biased by spring 114 to cause locking finger 121 to engage notch 110 of shackle 22, wall panel 127 simultaneously biases reinforcing bar 130 in the same direction, maintaining the opposed surface of reinforcing bar 130 in contact with proximal end 128 of push rod 112. In addition, this position places pins 117, 118, in 119 of sliding plate 111 in their disengaged position, spaced away from clutch rings 53, 54, and 55, as shown in FIGS. 11 and 12.

Furthermore, wall panel 126 is positioned within the elongated slot 129 of push rod 112 positioned directly adjacent and in contact with ridge 86 of cylinder 82. Furthermore, due to the biasing forces of spring 114, wall panel 126 is continuously biased into engagement with ridge 86.

By employing this construction of the present invention, a user is assured that padlock 20 is maintained in the locked position, whenever desired by the user, until either combination controlled locking section 23 or key controlled locking section 24 is activated by the user. In this regard, once padlock 20 is in the locked configuration, shackle 22 is secured within the housing of padlock 20, and maintained in this position by the engagement of locking finger 121 of locking place 113 in notch 110 of shackle 22. Regardless of any force imposed by an individual on distal end 125 of push rod 112, in an attempt to open padlock 20, no movement of push rod 112 is capable of being achieved due to the non-alignment of one or more pins 117, 118, and 119 with receiving slots 60, 61, and/or 62. This position is depicted in FIGS. 11 and 12.

Figure 13:
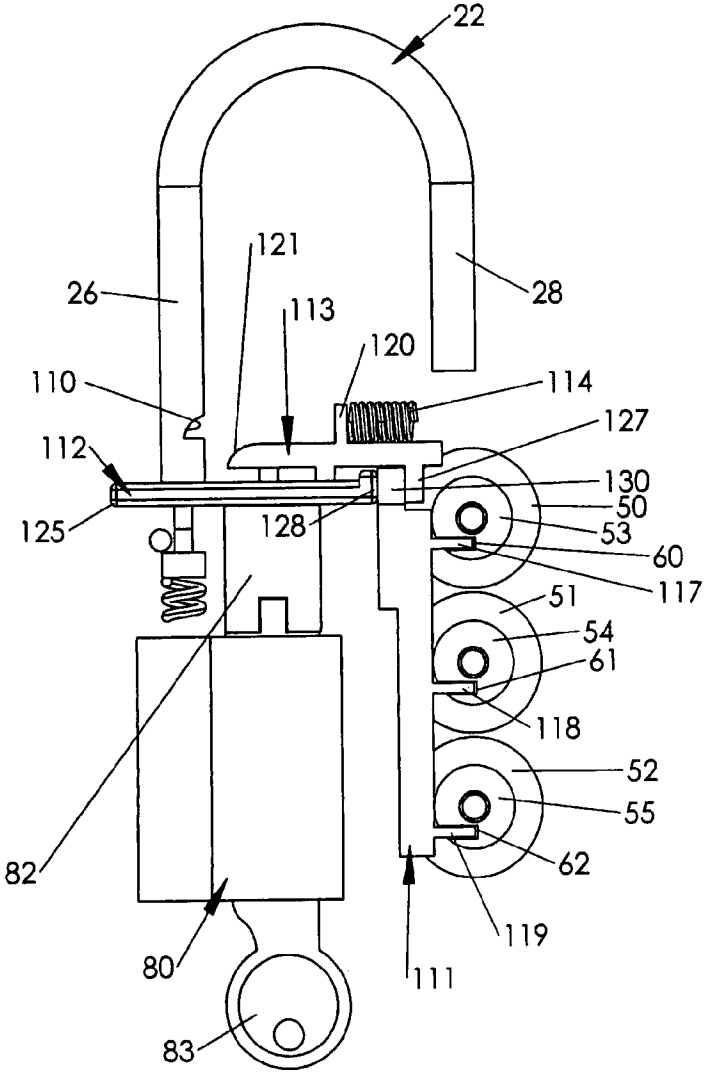
FIG. 13 is a side elevation view of the padlock of FIG. 11 shown with the front and rear covers are removed and with the padlock in the open position by employing the combination portion thereof.
Figure 16:
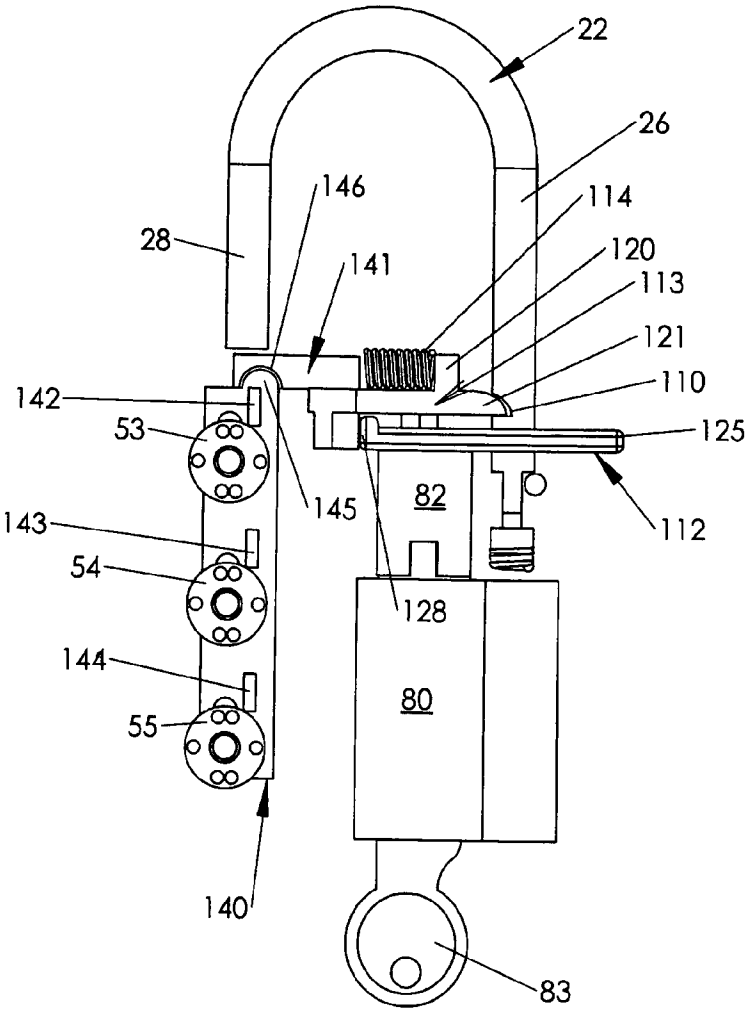
FIG. 16 is a rear side elevation view of the padlock of FIG. 15.
Figure 15:
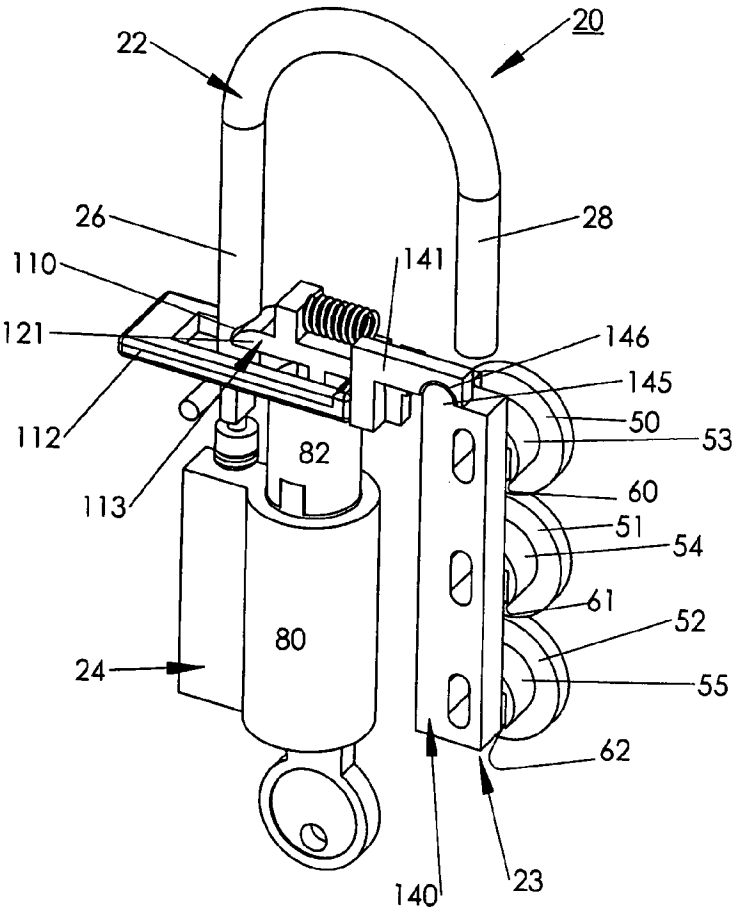
FIG. 15 is a perspective view of a third embodiment of the padlock of the present invention with the fully integrated dual locking system shown in the locked position, with both the front and rear covers removed.
Figure 18:
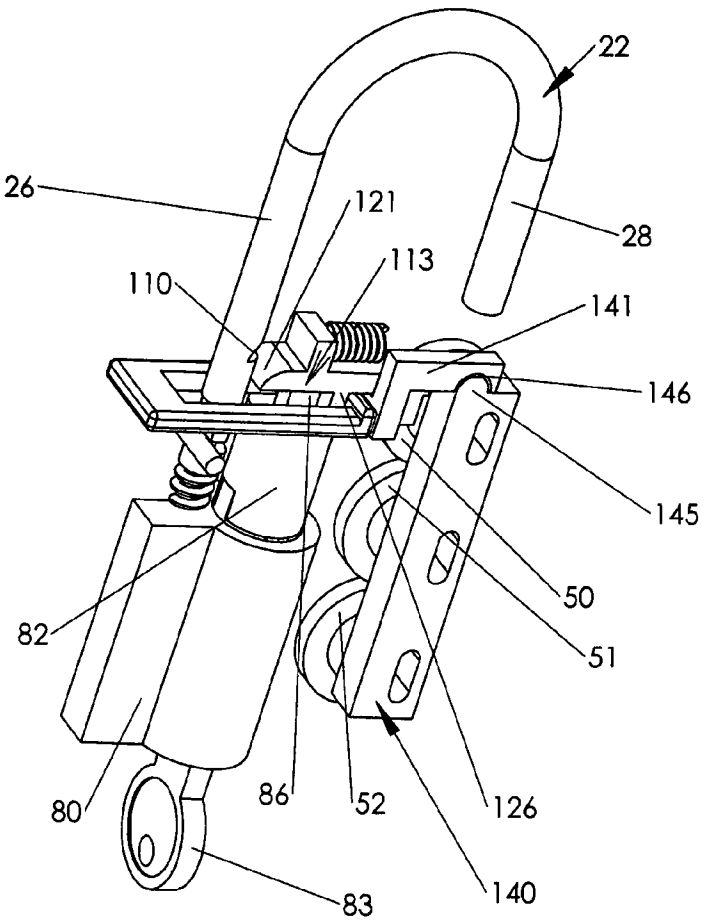
FIG. 18 is a perspective view of the padlock of FIG. 15 shown with the front and rear covers removed and with the padlock in the open position by employing the key operated portion thereof.
Figure 17:
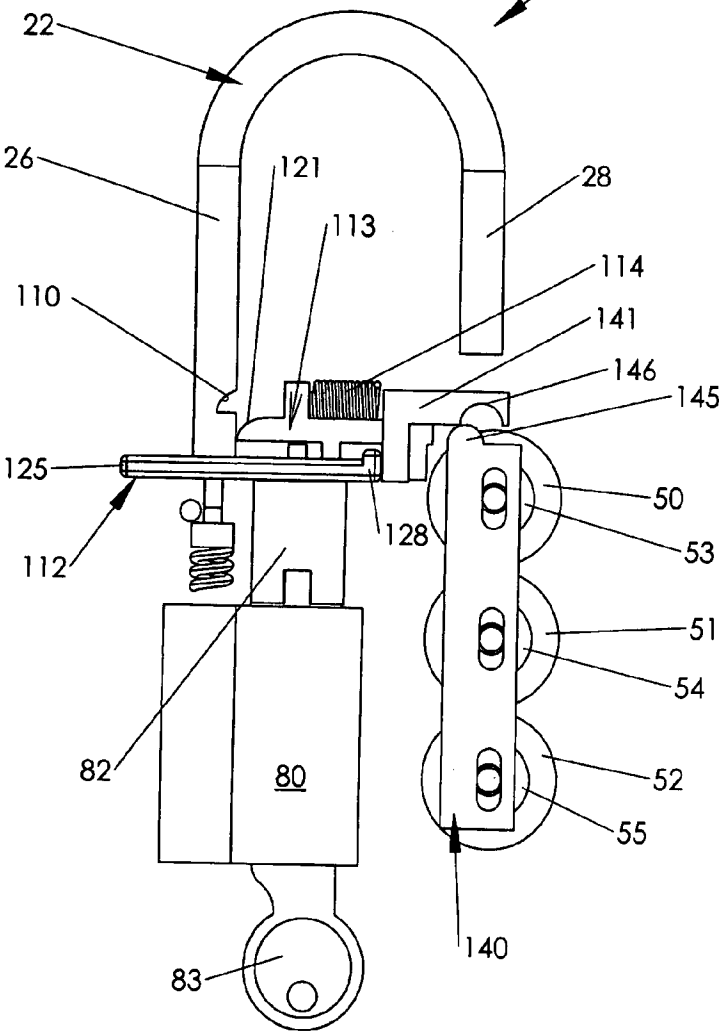
FIG. 17 is a side elevation view of the padlock of FIG. 15 shown with the front and rear covers are removed and with the padlock in the open position by employing the combination portion thereof.
Figure 20:
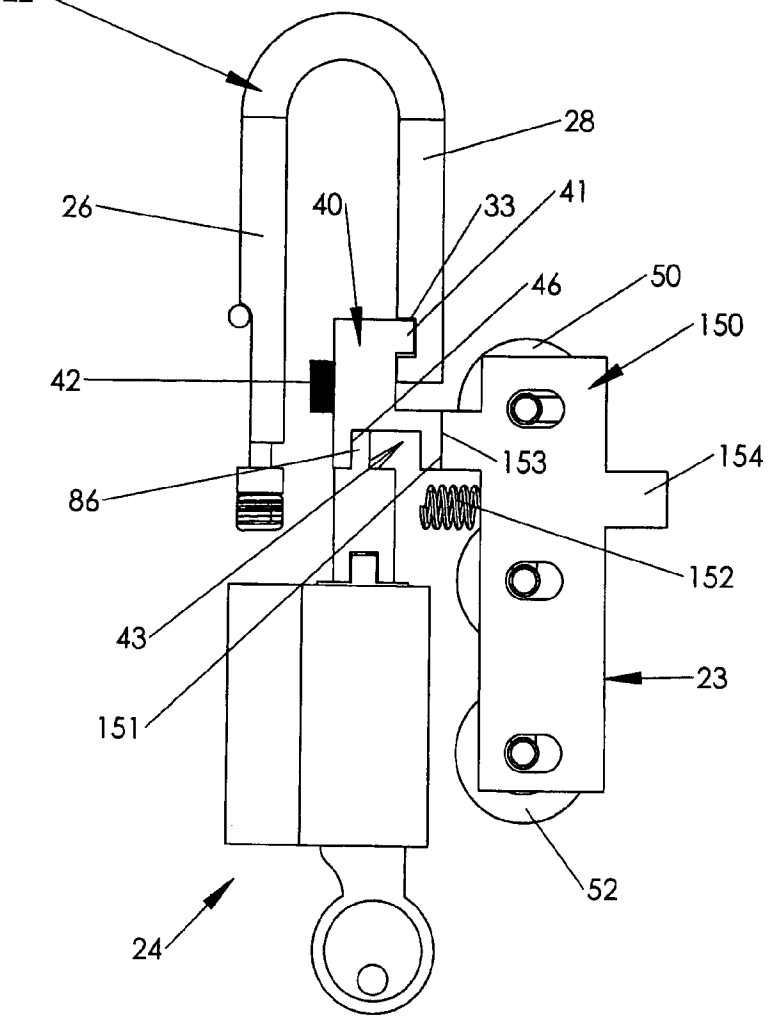
FIG. 20 is a side elevation view of the padlock of FIG. 19.
Figure 19:
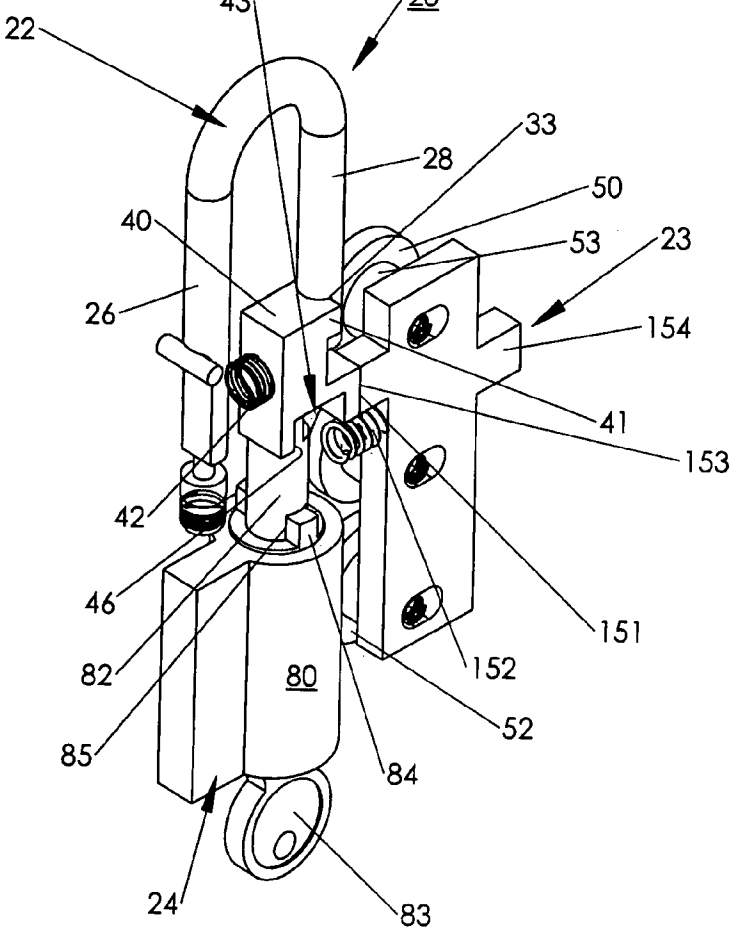
FIG. 19 is a perspective view of a fourth embodiment of the padlock of the present invention with the fully integrated dual locking system shown in the locked position, with both the front and rear covers removed.
Figure 23:
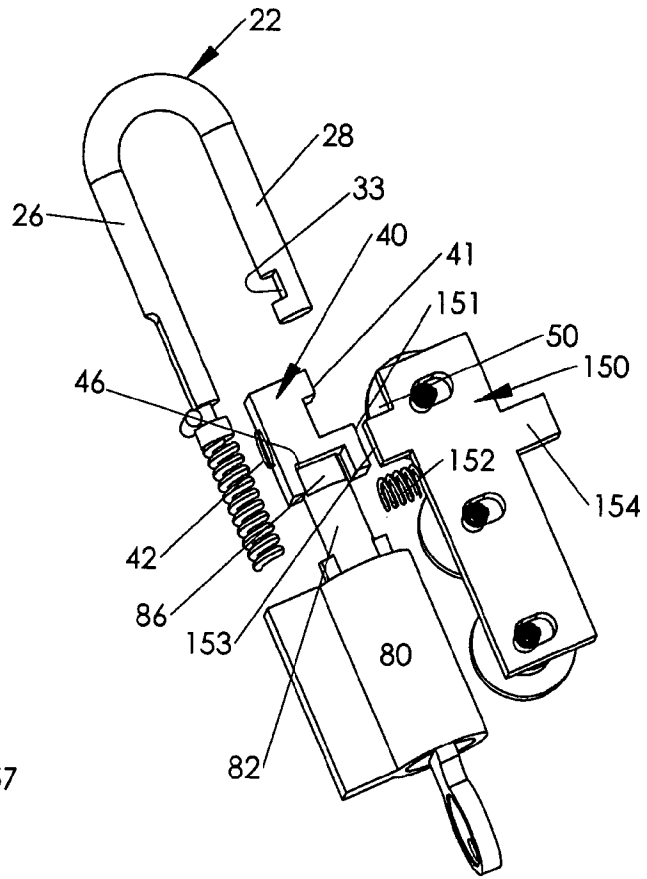
FIG. 23 is a perspective view of the padlock of FIG. 19 shown with the front and rear covers removed and with the padlock in the open position by employing the key operated portion thereof.
Figure 22:
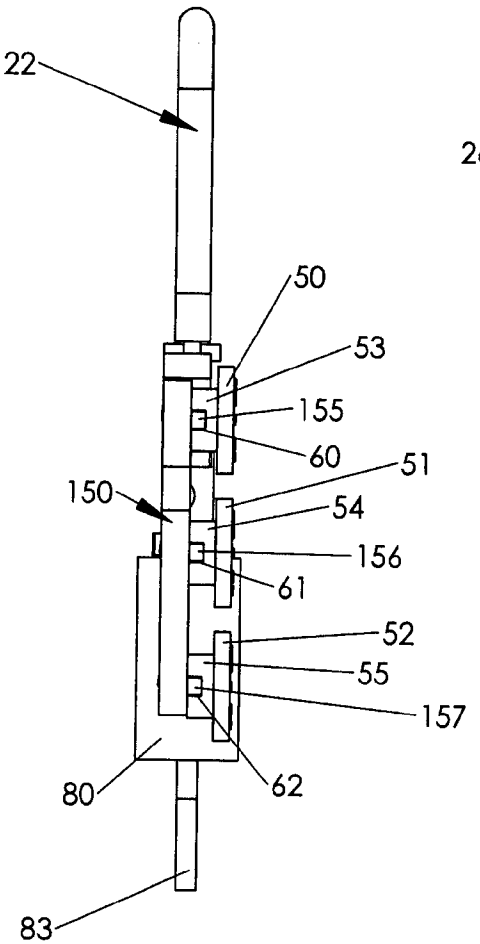
FIG. 22 is a front end elevation view of the padlock of FIG. 21.
Figure 21:
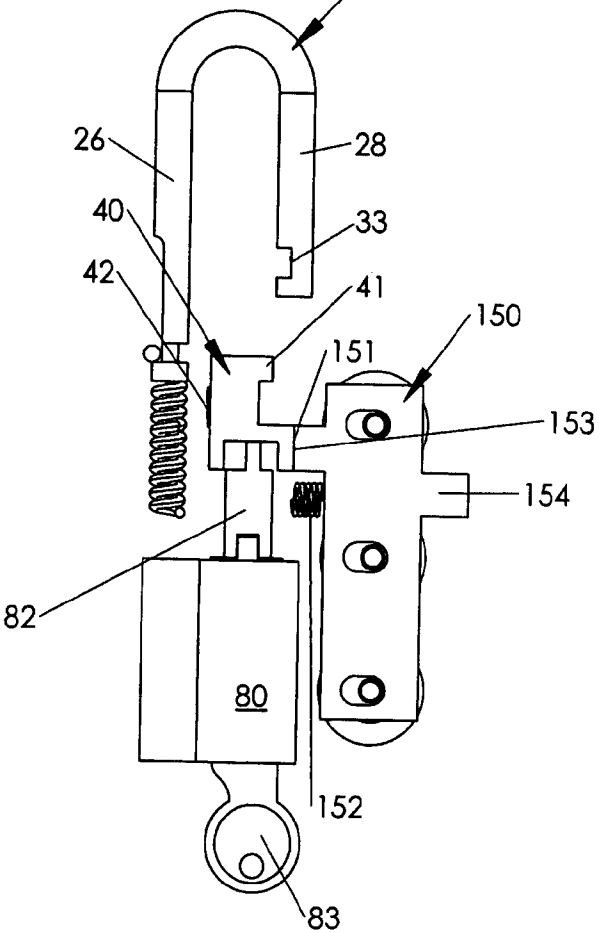
FIG. 21 is a side elevation view of the padlock of FIG. 19 shown with the front and rear covers are removed and with the padlock in the open position by employing the combination portion thereof.

As shown in FIG. 13, whenever the correct combination has been inputted on dials 50, 51, and 52, receiving slots 60, 61, and 62 of clutch rings 53, 54, and 55 are aligned with pins 117, 118, and 119 of sliding plate 111. Once this aligned position has been attained, any force placed upon distal end 125 of push rod 112 causes proximal end 128 to force reinforcing bar 130 sideways, in the direction of the force of being imposed, causing pins 117, 118, in 119 to enter receiving slots 60, 61, and 62.

In addition, this sideways force also causes reinforcing bar 130 to impose the identical force on wall panel 127 which causes latching plate 113 two counteract spring biasing force of spring 114, while simultaneously moving latching plate 113 in the same direction, causing locking finger 121 to be removed from the engagement with notch 110 of shackle 22. Once locking finger 121 has been disengaged from notch 110, shackle 22 is released and is capable of being automatically moved into the unlocked position, disengaged from the housing of padlock 20.

As is evident from this foregoing detailed discussion, this embodiment of the present invention provides an alternate construction in which padlock 20 can be quickly and easily unlocked by employing combination controlled locking section 23. In this regard, once the predetermined combination has been properly set on dials 50, 51, and 52, an opening force is imposed upon distal end 125 of push rod 112, causing shackle 22 to be released from locked engagement in the housing of padlock 20. In this way, quick, easy, rapid unlocking of padlock 20 is attained.

In addition, as with the embodiment detailed above, this alternate construction of the present invention also incorporates key controlled locking section 24 to be employed independently for unlocking shackle 22 from engagement with the housing of padlock 20. In employing this portion of padlock 20, the user operates cylinders 81 and 82, and the manner detailed above, by employing key 83.

By rotating cylinder 81 in housing 80 after key 83 has been properly inserted, the rotation of cylinders 81 and 82 are achieved. This rotation causes ridge 86 to arcuately rotate about its central axis. This rotational movement causes ridge 86 to engage wall panel 126 of latching plate 113, forcing latching plate 113 to move sideways against the biasing force of spring 114. This sideways movement causes locking finger 121 to become disengaged from notch 110 of shackle 22, releasing shackle 22 from the locked position into the unlocked position. In this way, the second, alternate method for unlocking padlock 20 is easily employed for attaining the desired result.

As is evident from the foregoing detailed disclosure, two alternate embodiments for dual locking mode padlock 20 of the present invention have been fully detailed. In this regard, both alternate preferred embodiments incorporate a combination controlled locking section 23 and a key controlled locking section 24 which enable the user to unlock padlock 20 using either section independently. As a result, the user is able to lock/unlock padlock 20 using either of the two alternate modes provided.

Furthermore, each embodiment, as detailed above, provides an effective and efficient padlock attaining all of the desired goals and objects, while achieving a product incorporating a minimum number of components which are easily manufactured and assembled in a completely sealed environment, thereby protecting all moving parts. As a result, all of the objects set out above are fully realized.

In addition to the two preferred embodiments detailed above, two further alternate preferred embodiments are depicted in FIGS. 15-23 and fully detailed below. In the third preferred embodiment depicted in FIGS. 15-18, padlock 20 is shown with the housing completely removed, enabling all of the internal components to be easily viewed and understood. Furthermore, this third alternate embodiment consists of an alternate variation of the second embodiment shown in FIGS. 11-14. Consequently, the same reference numerals are employed for identifying components repeated in these figures, wherein the components are virtually identical. In addition, the detailed discussion provided above regarding these components is incorporated herein by reference, with any further discussion of these components being eliminated in order to avoid repetition. However, any question regarding the construction and operation of the similar components can be fully understood by reference to the foregoing detailed disclosure.

In this third alternate preferred embodiment of the present invention, padlock 20 incorporates combination controlled locking section 23 and key controlled locking section 24. In addition, padlock 20 incorporates shackle 22 which is employed for locking and unlocking padlock 20 in response to the operation of combination controlled locking section 23 and/or key controlled locking section 24. In this regard, shackle 22 of this embodiment operates in a substantially identical manner to the shackle detailed above, with notch 110 formed in leg 26 of shackle 22, for cooperating with locking finger 121 of latching plate 113.

In order to avoid a repetitive duplication of the detailed disclosure provided above in reference to FIGS. 11-14, the following discussion focuses upon the principal variations incorporated into this third alternate embodiment which distinguish this embodiment from the embodiment detailed above. As a result, unless specifically mentioned herein, it is to be assumed that all of the components and/or elements incorporated into this embodiment of the present invention are substantially identical to the components and/or elements detailed in the foregoing disclosure of the alternate embodiments, and reference to the foregoing disclosure should be made for fully understanding any construction details not specifically addressed below.

In the construction of this embodiment of the present invention, the principal distinguishing elements incorporated herein are movable plate 140 and interconnecting bracket 141. In this preferred construction, movable plate 140 incorporates a plurality of upstanding pins or ridges 142, 143, and 144 (shown in FIG. 16) which are positioned for cooperating, sliding engagement in pin receiving slots 60, 61, and 62 formed in clutch rings 53, 54, and 55. As with the embodiments detailed above, whenever dials 50, 51, and 52 are in the correct, predetermined position, receiving slots 60, 61, and 62 are aligned with pins/ridges 142, 143, and 144, thereby enabling plate 140 to move vertically downwardly, when an input force is imposed thereon. However, whenever one or more dials 50, 51, and 52 are in an incorrect position or orientation, vertical movement of plate 140 is prevented.

In order to provide the desired controlled vertical movement of plate 140 when the correct predetermined combination has been inputted onto dials 50, 51, and 52, movable plate 140 incorporates upstanding, rounded boss 145 formed on the upper terminating edge thereof, in position for cooperative engagement in rounded recess 146 formed in the terminating end of bracket 141. As depicted, whenever dials 50, 51, and 52 are properly positioned, the user is able to input a force on terminating end 125 of pushrod 112, causing pushrod 112 to move sideways along with latching plate 113. This movement also causes locking finger 121 to be removed from notch 110, releasing shackle 22.

In addition, this sideways movement simultaneously causes bracket 141, to move horizontally due to the input force. Furthermore, this horizontal or sideways movement causes rounded recess 146 to engage and override curved boss 145, forcing plate 140 to move downwardly in response thereto.

Whenever dials 50, 51, and 52 are not in the predetermined position, vertical movement of plate 140 is prevented, since pins/ridges 142, 143, and 144 are incapable of entering slots 60, 61, and 62 of clutch rings 53, 54, and 55. As a result, vertical movement of plate 140 is prevented and, simultaneously therewith, sideways movement of pushrod 112 and latching plate 113 is also prevented, thereby preventing the release of shackle 22.

As is evident from the foregoing detailed discussion, this alternate embodiment provides a further construction for effectively achieving a combination controlled locking section 23 which employs a minimum number of components and provides a reliable and highly effective operational system for enabling the user to readily move padlock 20 between its locked configuration and unlocked configuration. Furthermore, this embodiment of the present invention also incorporates key controlled locking section 24 which operates in a manner substantially identical to the embodiment detailed above.

By referring to FIGS. 19-23, and the following detailed discussion, the fourth alternate preferred embodiment of the present invention can best be understood. In these figures, padlock 20 is depicted with the housing completely removed, enabling all of the internal components to be easily viewed and understood. Furthermore, this fourth alternate embodiment comprises a variation of the first embodiment depicted in FIGS. 1-4 and fully detailed above. Consequently, the same reference numerals are employed for identifying similar components incorporated into this embodiment, wherein the components are virtually identical.

In addition, the detailed discussion provided above regarding these components is incorporated herein by reference, with the detailed discussion of these components being eliminated in order to avoid repetition. However, any question regarding the construction and operation of the similar components can be fully understood by reference to the foregoing detailed disclosure.

In this fourth alternate preferred embodiment of the present invention, padlock 20 incorporates combination controlled locking section 23 and key controlled locking section 24. In addition, padlock 20 incorporates shackle 22 which is employed for locking and unlocking padlock 20 in response to the operation of either combination controlled locking section 23 and/or key controlled locking section 24. In this regard, shackle 22 of this embodiment operates in a substantially identical manner to the shackle detailed above, with notch 33 formed in leg 28 of shackle 22 for cooperating with locking finger 41 of latch plate 40.

In order to avoid a repetitive duplication of the detailed disclosure provided above in reference to FIGS. 1-4, the following discussion focuses upon the principal variations incorporated into this fourth alternate embodiment which distinguish this embodiment from the embodiment detailed above. As a result, unless specifically mentioned herein, it is to be assumed that all of the components and/or elements incorporated into this embodiment of the present invention are substantially identical to the components and/or elements detailed in the foregoing disclosure of the alternate embodiments and in reference to the foregoing disclosure should be made for fully understanding any construction details not specifically addressed below.

In the construction of this embodiment of the present invention, the principal distinguishing elements incorporated herein comprise slider plate 150 and the controlled engagement of slider plate 150 with flat surface 151 of latch plate 40. Furthermore, biasing spring 152 is also employed for controlling the lateral or sideways movement of slider plate 150, while also assuring that slider plate 150 is normally biased into the closed and locked configuration.

In addition, slider plate 150 incorporates flat control surface 153 which is constructed for being maintained in abutting contact with flat surface 151 of latch plate 40. In this way, the sideways movement of slider plate 150 causes control surface 153 to engage surface 151 of latch plate 40, forcing latch plate 40 to move against the biasing forces of spring 42, effectively removing locking finger 41 from engagement in notch 33 of shackle 22, thereby enabling shackle 22 to be released from its locked position into its unlocked position.

In order to control the movement of slider plate 150, slider plate 150 incorporates a pushbutton or activation surface 154. As depicted in the preferred embodiment, pushbutton/activation surface 154 extends laterally from the side edge of slider plate 150, having a sufficient length to extend outwardly from the housing of padlock 20. However, as would be apparent to anyone having ordinary skill in this art, any other control surface or position can be employed with equal efficacy.

As with the embodiments detailed above, the slider plate 150 incorporates a plurality of upstanding pins or ridges 155, 156, and 157 which extend from a surface of slider plate 150 and are positioned for cooperating, sliding engagement in pin receiving slots 60, 61, and 62 formed in clutch rings 53, 54, and 55. As detailed above, whenever dials 50, 51, and 52 are in the correct, predetermined position, receiving slots 60, 61, and 62 are aligned with pins/ridges 155, 156, and 157, in order to enable slider plate 150 to move in a lateral or sideways direction when a force is imposed upon activation button/surface 154. However, whenever dials 50, 51, and/or 52 are in an incorrect position or orientation, sideways movement of slider plate 150 is prevented.

As is evident from the foregoing detailed discussion, this embodiment of the present invention provides padlock 20 with a combination controlled section 23 which enables the user to quickly and easily unlock padlock 20 by merely rotating dials 50, 51, and 52 into the predetermined positions. In addition, in this embodiment, padlock 20 is constructed with a minimum number of components for ease of assembly and reliability.

Furthermore, this embodiment of padlock 20 also incorporates key controlled locking section 24 which is constructed in a substantially identical manner to the constructions detailed above. In this regard, by employing key 83, cylinders 81 and 82 are easily rotated, causing ridge 86 to articulately pivot forcing surface 46 of latch plate 40 and latch plate 40 itself to move sideways against the force of spring 42, thereby removing locking finger 41 from notch 33. This movement releases shackle 22 from locked engagement and enabling shackle 22 to be removed from the housing of padlock 20.

It will thus be seen that the objects set forth above, among those made apparent from the preceding description, are efficiently attained and, since certain changes may be made in the above product without departing from the scope of the invention, it is intended that all matter contained in the above description or shown in the accompanying drawings shall be interpreted as illustrative and not in a limiting sense.

It is also to the understood that the following claims are intended to cover all of the generic and specific features of the invention herein described, and all statements of the scope of the invention which, as a matter of language, might be said to fall therebetween.

Having described our invention, what we claim as new and desire to secure by Letters Patent is:

1. A padlock constructed for providing two separate and independent locking means in a single, integrated construction, said padlock comprising:

A. a housing incorporating a first locking section constructed for being controlled by a combination and a second locking section constructed for being controlled by a key;

B. a shackle mounted in the housing and constructed for being movable between a first housing engaged and locked position and a second housing disengaged and open position and comprising two cooperating leg members interconnected by an arcuately curved intermediate section, with one of said leg members incorporating a notched zone;

C. a control assembly a. incorporating a shackle latching member mounted in the housing for movement between locking and holding engagement with the shackle when in a first position and disengagement and release of the shackle when in a second position, b. responsive to an activation force for moving the shackle latching member between its two positions, said activation force being provided by use of either the key controlled locking section or the combination controlled locking section; and c. said shackle latching member comprising a locking finger constructed for engaging with the notched zone of the leg member and being cooperatingly associated with a spring member positioned for normally biasing the locking finger of the latching member into engagement with the notched zone of the shackle leg for normally maintaining the shackle in its housing engaged and locked position; and D. said first combination controlled locking section comprising a. a plurality of dial members mounted to the housing for rotational movement relative thereto, with each of said dial members comprising an upstanding boss or clutch ring having a diameter smaller than the diameter of the dial member with each boss/clutch ring incorporating a receiving slot formed therein with said slot extending inwardly from the outer surface of the boss/clutch ring, with each of said slots being positioned for cooperating alignment with slot engaging members of a movable plate member, and b. the movable plate member mounted in the housing in cooperating relationship with the dial members and the shackle latching member, said movable plate member being movable between a first dial disengaged position and a second dial engaged position and incorporating 1. a plurality of slot engaging members formed thereon and positioned in aligned relationship with the receiving slots of the dial members for movement between a slot disengaged position when in its first position and a slot engaged position when in its second position, and 2. an engagement member extending from the movable plate and positioned in movement controlling relationship with the shackle latching member for enabling the shackle latching member to remain engaged with the notched zone of the shackle whenever said movable plate member is in its first position and enabling the shackle latching member to become disengaged from the notched zone of the shackle when the movable plate member is in its second position, thereby causing the locking finger of the shackle latching member to be disengaged from the notched zone of the shackle for enabling the shackle to move into its open and disengaged position;

whereby both separate and independent locking sections are capable of releasing the shackle by disengaging the same latching member.

2. The padlock defined in claim 1, wherein said key controlled locking section is further defined as comprising a cylinder assembly mounted in the housing and incorporating a cylinder member constructed for being rotationally movable in response to the insertion of a designated key member and comprising an upstanding flange mounted to the distal end of the cylinder member for arcuate movement with the movement of the cylinder member and positioned for cooperating engagement with the shackle latching member for causing the shackle latching member to move from its first position to its second position whenever the cylinder member is rotated, thereby causing the locking finger of the shackle latching member to be disengaged from the notched zone of the shackle.

3. The padlock defined in claim 1, wherein said engagement member is further defined as extending from the movable plate and terminating with a ramped, sloping end surface with said ramped, sloping end surface contacting a cooperating ramped camming surface formed on the shackle latching member, whereby movement of the movable plate causes a camming action between said ramped surfaces, forcing the shackle latching member to move away from the movable plate for disengaging the locking finger thereof from the notched zone of the shackle.

4. The padlock defined in claim 1, wherein each of said dial members is further defined as comprising a plurality of indicia formed on a larger diameter dial portion thereof, each of said indicia representing various positions of the rotatable dial member with at least one of said positions being consistent with the aligned position of the slot with the associated slot engaging member of said movable plate member, with the indicia designating the aligned position representing one component of the predetermined combination.

5. The padlock defined in claim 4, wherein each upstanding boss/clutch ring of each rotatable dial member is independently rotatable relative to the dial portion, enabling the user to position the slot formed in the boss/clutch ring in any desired position relative to the indicia formed on said dial portion, thereby allowing the user to develop any desired customized combination of indicia for releasing the shackle from locked engagement with the latching member.

6. The padlock defined in claim 5, wherein each of the slot engaging members of the movable plate member is further defined as comprising an elongated finger positioned for cooperative aligned engagement in a slot of a boss/clutch ring of the dial members.

7. The padlock defined in claim 6, wherein the movable plate member is further defined as being vertically movable relative to the dial members for enabling the fingers formed thereon to enter the aligned slots of the dial members by the application of an activating force on the plate member.

8. The padlock defined in claim 6, wherein the movable plate member is further defined as being horizontally movable relative to the rotatable dials members for enabling the fingers formed thereon to enter the aligned slots of the rotatable dials by the application of an activating force on the plate member.

9. The padlock defined in claim 6, wherein each of the slot engaging members of the movable plate member is further defined as comprising an upstanding ridge or wall formed on the plate member and positioned for cooperative aligned engagement in a slot of a boss/clutch ring of the dial members.

10. The padlock defined in claim 9, wherein the movable plate member is further defined as being moved in its entirety by an activating force for causing the upstanding ridges or walls to move between the slot disengaged position and the slot engaged position.

11. The padlock defined in claim 2, wherein the combination controlled locking section of the housing is further defined as comprising a control arm or pushbutton cooperatively associated with the movable plate member for moving the plate member between its two alternate positions while simultaneously moving the shackle latching member between its engaged position and its disengaged position with the notched zone of the shackle.

* * * * *